United States Patent [19]

Frech

[11] 4,054,225

[45] Oct. 18, 1977

[54] REFUSE CONTAINER ASSEMBLY

[76] Inventor: Thomas D. Frech, 706 E. Park, Arlington Heights, Ill. 60005

[21] Appl. No.: 766,788

[22] Filed: Feb. 8, 1977

[51] Int. Cl.[2] ..... B65D 25/14
[52] U.S. Cl. ..... 220/63 R
[58] Field of Search ..... 220/17, 63 R, 65, 1 T; 248/95, 97, 98; 232/43.1, 43.2

[56] References Cited

U.S. PATENT DOCUMENTS

| | | | |
|---|---|---|---|
| 1,218,632 | 3/1917 | Derry | 220/65 X |
| 2,112,465 | 3/1938 | Maish | 220/65 X |
| 3,179,332 | 4/1965 | Brighton et al. | 232/43.2 |
| 3,734,340 | 5/1973 | Ippolito et al. | 220/1 TX |

FOREIGN PATENT DOCUMENTS

| | | | |
|---|---|---|---|
| 1,176,563 | 8/1964 | Germany | 220/1 T |
| 111,891 | 9/1967 | Norway | 220/65 |
| 117,531 | 8/1969 | Norway | 232/43.2 |

*Primary Examiner*—Stephen Marcus
*Attorney, Agent, or Firm*—Cushman, Darby & Cushman

[57] ABSTRACT

A flexible refuse container with an open top, a closed bottom having ventilation holes therethrough and a continuous sidewall slit from the top to adjacent the bottom is disclosed. A plurality of latches adjacent the split permit the container to be placed in a fill position with the slit edges in close relationship for filling a plastic liner bag within the container, or in an unload position with the slit open to permit easy removal of a filled bag without tearing.

6 Claims, 4 Drawing Figures

REFUSE CONTAINER ASSEMBLY

BACKGROUND OF THE INVENTION

Plastic films formed into disposable trash bags are frequently used, indeed required by some jurisdictions, for the containment and disposal of household refuse. Common practice is to insert the film liner or bag into a cylindrical, open-ended container, usually known as a garbage can. The liner is folded over the upper edge or lip of the garbage can and the user inserts the refuse material as required until the capacity of the container is reached. The liner is folded, gathered together and the liner is removed from the container. Frequently, however, difficulty in removing a full plastic liner is encountered due, in part, to a negative pressure formed in the space between the bottom portion of the bag and the cylindrical container as the filled bag is withdrawn from the garbage can. This problem is particularly acute when the plastic liner is filled with loose, particulate matter such as leaves, grass clippings and the like, as they tend to settle in the container and form a more uniform seal between the filled liner and the container. Bulky trash is also pushed outward by the weight above it to cause the bag to frictionally engage the container walls. As upward force is exerted on the top of the full bag during removal, the downward forces tend to rip the bag, spilling trash and requiring transfer to another bag.

SUMMARY OF THE INVENTION

I have discovered and now disclose a novel refuse container assembly free from the above-mentioned drawbacks which permits the easy and convenient removal of a plastic liner containing tightly packed leaves, grass, trash and the like from the noval container assembly without ripping the liner. The assembly includes an open ended refuse container, preferably cylindrical and made of a synthetic high polymer. The container has a longitudinal slit along its axis which slit is secured or held together by a latching device which can be manually released. In the fill position, the slit is closed with the opposite edges in close relationship for receiving a disposable film liner. In the unloaded position the slit expands by virtue of the flexibility of the polymer side walls, beginning at the bottom of the container and extending upwardly to the top or container opening. Ventilation holes are provided to ease removal of a full bag from the container.

DETAILED DESCRIPTION OF THE DRAWINGS

Figure 1:
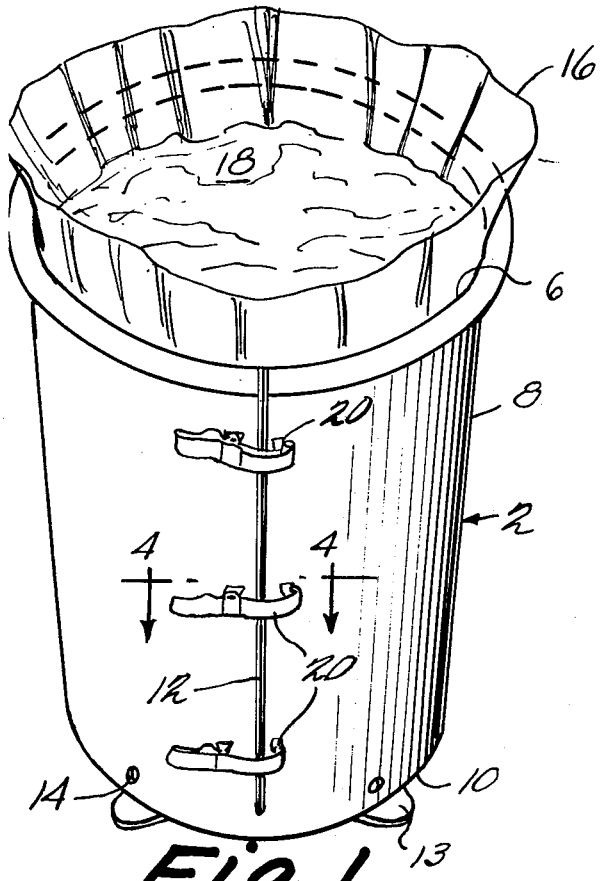
FIG. 1 is an elevated perspective view of the refuse container assembly in the fill position including a film liner filled with refuse.
Figure 3:
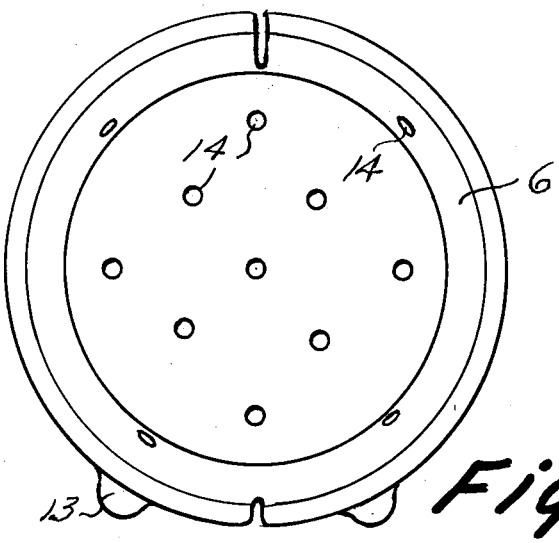
FIG. 3 is a top plan view of the refuse container assembly in the fill position.

FIG. 1 shows, in perspective view, the refuse container assembly 2 with a top plan view as in FIG. 3. The container assembly includes an upper or top opening 6 preferably provided with a lip or rolled edge as shown to receive and retain film liner 16. Alternatively, a reinforced lip around the opening, grooves about the circumference of the opening and clamping or constriction means to retain the film liner 16 or bag in in position while the assembly 2 is being filled can be used (not shown). Preferably the upper opening 6 is sized for a standard 20 or 30 gallon capacity garbage can so that commercially available disposable film garbage bags can be used. Disposable bags of various shapes, strengths and rigidity may also be used. The assembly also includes a continuous sidewall 8 around the circumference of the container and an integral bottom 10. A lap seam or slit 12 is provided extending from the upper opening 6 of the container, generally along the axis of the container and terminating at or near the bottom 10 of the container. Preferably the container is tapered, as shown, increasing in cross-section from bottom to top. As will be seen from FIG. 2 where the slit 12 extends from the upper opening 6 and terminates at or near the bottom 10 of the container, the opening thereby defined is restrained from further increasing in width by the positioning of the slit at or near the bottom of the container.

Retainer tabs 13 are optionally provided along the base of the container. In use when the liner 16 is filled the user places his feet on tabs 13 which secures the container to the surface while the filled liner is lifted out.

The container has optional apertures 14 along the lower portion of sidewall 8 as shown in FIG. 1 and spaced uniformly about the bottom 10 as shown in FIG. 3. Apertures 14 provide air pressure relief passages which facilitate removal of the filled liner or bag from the container. It is to be understood that any desired configuration of holes or apertures may be used.

Figure 4:
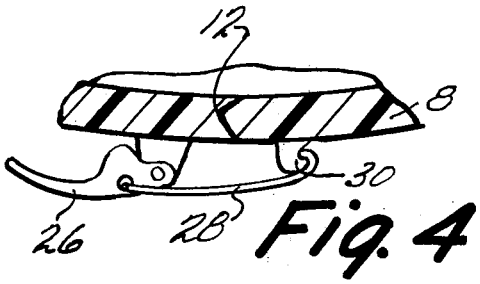
FIG. 4 is a detailed top view of the seam and latching assembly also in the closed position as shown in FIG. 1 along section line 4—4.

The container is provided with closing and opening means along seam 12 and as shown in the drawings these may be in the form of several manually operated, conventional latches 20 shown in FIG. 1 in the closed position and in more detail in FIG. 4. The latches are releasable and in the closed position secure the sidewall together along seam 12. Alternative mechanical closures include overlapping rigid plastic snaps, metal clamps, springs either in the seam area or around the entire circumference of the container, and other closure mechanisms as will be apparent to one skilled in the art.

Figure 2:
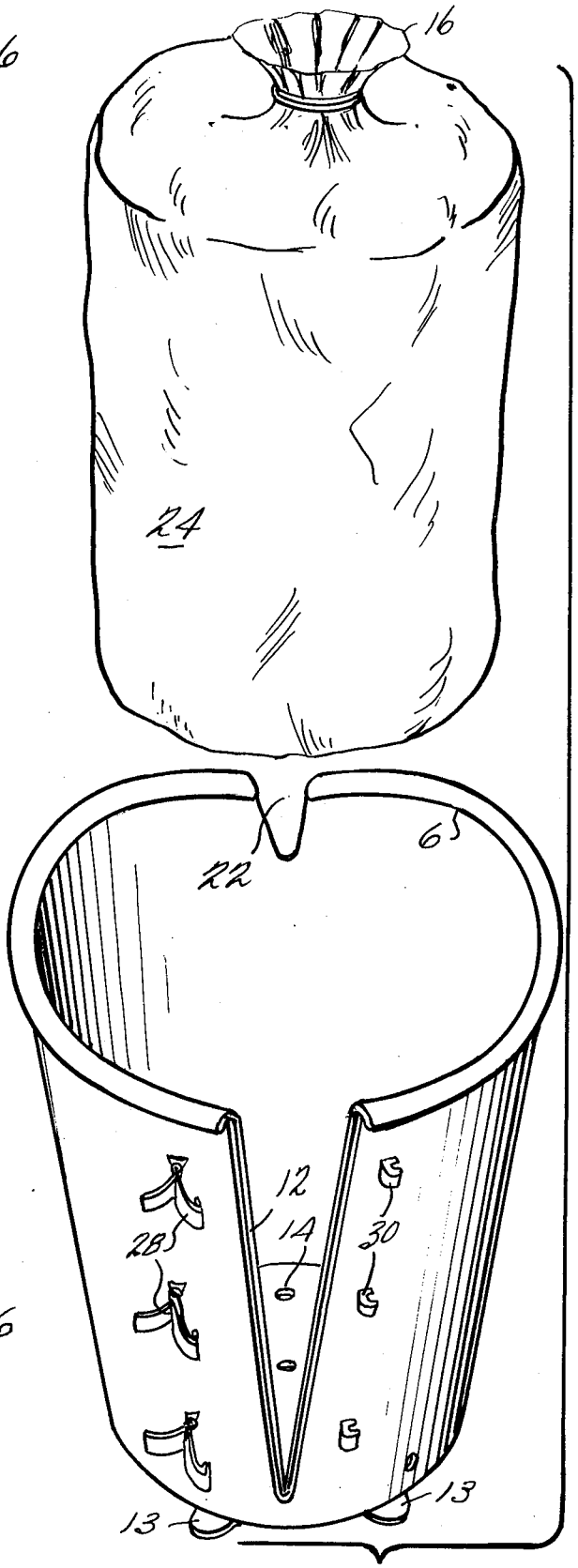
FIG. 2 is an elevated perspective view of the refuse container assembly in the unloaded position and the filled, secured film liner removed from the assembly.

FIG. 1 shows the film liner 16 containing refuse 18 in the closed position for filling; FIG. 2 illustrates the container assembly 2, latches 20 released, in the unload position so that the filled film liner 24 is easily removed from the container. Releasing of the latches 20 increases the circumference of the upper opening 6 and apertures 14 allow negative pressure relief for the filled film liner 24 as it is extracted from the container. These features are addressed directly to the problem solved by my invention, that is to provide a sure yet economical construction for a refuse container that allows a filled film liner or garbage bag to be removed easily from the container itself. FIG. 2 also illustrates a notch 22 placed along the upper opening of the container to permit a more complete separation of the seam along the opposing area of the sidewall.

FIG. 4 is a detailed view of a typical latching assembly 20 which includes a releasable handle 26 secured to a post 30 rigidly fastened to or integral with sidewall 8, a hasp 28 which connects to retainer post 30 which is also secured to or integral with sidewall 8. Each latch is released in the usual manner by pulling outwardly on the handle releasing the hasp 28 from the retainer post and allowing the seam 12 to separate.

Further modifications and features for the above-described assembly are contemplated, and although not specifically illustrated in the attached drawings they include various means to secure the film liner to the side of the container. This is particularly desirable when the container is first being filled with refuse or the like. Also, while a lap seam or slit is preferred, other type seams can be alternatively employed. As with conventional garbage receptacles lids or covers and carrying handles may also be provided.

While the above description has been directed primarily to a device for end use as a refuse container it is to be understood that other applications are contemplated. For instance a bulk storage receptacle for industry. Various particulate materials are sold in commerce packaged in film bags. My invention finds application in any instance where the bags require support, as during filling.

The refuse container itself is preferably fabricated from a thermoplastic high polymer, high density polyethylene or polypropylene, including their copolymers, being readily available in commerce. Feet can be provided as part of the container bottom which can be stepped on to hold the container as the bag is lifted. Other materials, generally referred to as "plastics" may also be used provided they inherently possess the necessarily inherent properties of rigidity balanced against a flexibility feature at least sufficient to allow the container to open and release the filled bag received in it.

For these reasons metal, and particularly galvanized steel is not a preferred material.

What is claimed is:

1. A refuse container comprising:

a flexible container having an open top, a bottom and a continuous side wall integrally attached to said bottom, said side wall having a slit extending longitudinally from said top to a location near said bottom, and releaseable means for securing opposite edges of said slits in close relationship when said container is in a fill position, said serving means being manually releasable so that the said edges move away from each other and the distance between said opposite edges increase along the direction from container bottom to container top to define an unload position.

2. A container as in claim 1 wherein said container includes a plurality of ventilating holes in the bottom of said container and in the sidewall of said container adjacent said bottom.

3. A container as in claim 1 wherein said container is plastic.

4. A container as in claim 1 wherein said container has a notch is the sidewall opposite said slit.

5. A container as in claim 1 further including a plastic film liner disposed in said container for holding trash and the like.

6. A container as in claim 1 wherein said securing means includes a plurality of latches attached to the outside of said sidewall along the length of said slit.

* * * * *